United States Patent [19]

Dolizy et al.

[11] Patent Number: 4,490,605

[45] Date of Patent: Dec. 25, 1984

[54] PHOTOELECTRIC DETECTION STRUCTURE

[75] Inventors: Pierre Dolizy, Ris-Orangis; Francoise Grolière, Nogent-sur-Marne, both of France

[73] Assignee: U.S. Philips Corporation, New York, N.Y.

[21] Appl. No.: 337,917

[22] Filed: Jan. 8, 1982

[30] Foreign Application Priority Data

Jan. 21, 1981 [FR] France ..... 81 01039

[51] Int. Cl.[3] ..... H01J 31/50

[52] U.S. Cl. ..... 250/213 VT; 313/541

[58] Field of Search ..... 250/213 VT, 211 R, 211 J; 313/524, 541

[56] References Cited

U.S. PATENT DOCUMENTS 3,254,253 5/1966 Davis et al. ..... 313/524

*Primary Examiner*—David C. Nelms

*Attorney, Agent, or Firm*—Marc D. Schechter

[57] ABSTRACT

The photoelectric device comprises a photosensitive layer on a substrate which is transparent to incident radiation. An intermediate layer for optically adapting the photosensitive layer to the substrate is provided therebetween. The respective thicknesses of the intermediate layer and the photosensitive layer are proportioned so that photon absorption takes place in the photosensitive layer near the output of the layer within a distance on the order of magnitude of the escaping depth of the electrons. Photon absorption takes place in such manner that the efficiency of the photoemission of the structure is optimum taking into account the nature of the materials of the layers.

20 Claims, 6 Drawing Figures

PHOTOELECTRIC DETECTION STRUCTURE

BACKGROUND OF THE INVENTION

The invention relates to a photoelectric detection device for radiation having wavelengths in a given range of the spectrum. The device comprises, in an evacuated envelope, a photosensitive layer which is provided on a substrate which is transparent to incident radiation. The device further comprises an intermediate layer for optical adaptation. The intermediate layer is also transparent to the incident radiation, and it is provided between the photosensitive layer and the substrate. The refractive index of the material of the intermediate layer is between that of the substrate and that of the material of the photosensitive layer. Such devices may be, for example, photoelectric cells, image intensifier tubes, display tubes integrated in television pick-up systems, or photomultipliers.

When a photoelectric detection device comprises a photosensitive layer provided directly on a substrate, this results in general in a poor optical adaptation of the photosensitive layer to the substrate. As a result, a large part of the light incident on the substrate is not effectively used for the conversion of photons into electrons. The photoelectric detection efficiency of the device is thereby considerably reduced. It is known to improve the efficiency of such a device by attenuating the reflections formed at the interface between the substrate and the photosensitive layer. The reflections are attenuated by means of one or more intermediate layers which are transparent to the incident radiation and which are disposed between the substrate and the photosensitive layer.

Such a device having only one single intermediate layer is known, for example, from U.S. Pat. No. 3,254,253 (Davis, et al). The intermediate layer in this case has been chosen for its weak absorption. Moreover, the optical constants and the thickness of the intermediate layer are chosen such that, taking into account the optical constants of the substrate and of the photosensitive layer, the reflected light rays at the interface between the substrate and the intermediate layer and the reflected rays at the interface between the intermediate layer and the photosensitive layer, respectively, have exactly the same amplitude and opposite phases so that they neutralize each other by interference.

Such a device attenuates the losses as a result of reflections to a considerable extent but does not necessarily result in a device having an optimum efficiency.

SUMMARY OF THE INVENTION

It is an object of the invention to provide a photoelectric detection device which comprises a photosensitive layer supported by a substrate which is transparent to incident light. The device also has a transparent intermediate layer between the substrate and the photosensitive layer. The efficiency of the device is optimized taking into account the nature of the materials of the substrate and of the photosensitive and intermediate layers, respectively.

According to the invention, in a device of the kind described above the thickness e of the photosensitive layer and the thickness $e_1$ of the intermediate layer are proportioned so that the absorption of the photons in the relevant range of the spectrum takes place in a portion of the photosensitive layer near the interface of the layer with the vacuum in the device. This portion of the photosensitive layer, starting from the interface, has a thickness on the order of magnitude of the escaping depth L of the produced photoelectrons.

The invention can be understood with reference to the theoretical formulae of the efficiency of photoemission of a photoelectric detection device, with or without an intermediate layer between the substrate and the photosensitive layer. The absorption of the light is assumed to take place in the photosensitive layer.

If no intermediate layer is present, the efficiency depends on the thickness of the photosensitive layer and on the optical constants thereof n k (n is the refractive index and k and the extinction index of the material). The formula for the efficiency reads as follows.

$$\rho_\lambda = P(W, O) \int_0^e A_\lambda(n,k,x) f(x,L)\, dx, \tag{1}$$

wherein the symbols used have the following meanings;

x = the distance between (i) the interface of the photosensitive layer and the vacuum of the tube (x = 0 at this interface), and (ii) the place of absorption of the photons in the layer measured at right angles to the interface;

W = the energy of the photoelectrons;

A (n,k,x) = the absorption function of the radiation of wavelength λ in the photosensitive layer at the distance x from the interface between the photosensitive layer and the vacuum;

P (W,O) = the escaping probability of the photoelectrons at the interface (equal to unity in the following applications);

L = the escaping depth of the photoelectrons from the photosensitive layer;

f (x,L) = the formula which represents the transport of the electrons in the layer;

e = the thickness of the photosensitive layer.

With an intermediate layer having a thickness of $e_1$ and with optical constants $n_1$ and $k_1$ ($n_1$ is the refractive index and $k_1$ is the extinction index) located between the substrate and the photosensitive layer, the absorption function Aλ of the photons in the photosensitive layer depends not only on n, k and x but also on $e_1$, $n_1$ and $k_1$. Thus the formula for the efficiency Pλ of the photoemission of the modified structure reads as follows.

$$\rho_\lambda' = P(W,O) \int_0^e A_\lambda(e_1, n_1, k_1, n, k, x) f(x,L)\, dx \tag{2}$$

Application of the formulae (1) and (2) and the formula for the transport of the electrons $f(x,L) = e^{(-X/L)}$ (where e denotes the Neperian number) for a few theoretical cases, and for a few experimental examples serves to illustrate the invention. The materials used for the substrate have a refractive index on the order of magnitude of 1.5 to 2 and those for the intermediate layer with transparent material ($k_1 \# 0$) have a refractive index larger than that of the substrate and smaller than that of the photosensitive layer.

BRIEF DESCRIPTION OF THE DRAWING

FIG. 6 also shows the sensitivity of the same photosensitive layer having a thickness of 1300 Å provided directly on a glass substrate.

DESCRIPTION OF THE PREFERRED EMBODIMENTS

Figure 1:
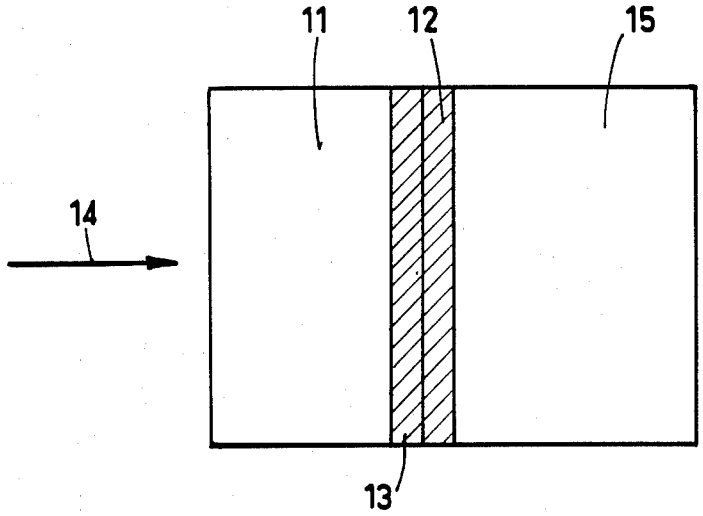
FIG. 1 is a partly schematic, partly sectional view of the photoelectric detection device according to the invention.

FIG. 1 is a sectional view of an embodiment of a device in which the substrate consists of a disc 11 which is transparent to radiation. A photosensitive layer 12 having a thickness e, is provided on an intermediate layer 13 on the substrate 11. The intermediate layer 13 is also transparent to radiation, and it has a thickness $e_1$ for the optical adaptation between the substrate 11 and photosensitive layer 12. This stacked construction forms the input of a photoelectric tube in which the light to be detected is incident on the left-hand side of the stack in the direction of the arrow 14. The vacuum of the tube 15 is on the right-hand side of the photosensitive layer 12.

According to a first embodiment of the invention the efficiency of the photoemission of the photosensitive layer is improved. An example of this embodiment includes a photosensitive layer of the type S20, trialkaline having the chemical formula (Sb $Na_2$ K, Cs). This photosensitive layer is provided directly on a glass substrate having a refractive index on the order of magnitude of 1.5 in the blue, green and red regions of the visible spectrum centered on the wavelengths of λ=4360 Å, λ=5460 Å, and λ=8000 Å, respectively. The efficiency ρλ of the photoemission of such a layer is maximum in each of the wavelength regions for a given value of the thickness e of the layer. The order of magnitude of this value is indicated on line 2 of Table I (below) dependent on the spectral region. The corresponding efficiency of the photoemission is indicated on line 3 of Table I, expressed in the number of electrons per incident photon × 100%.

Figure 2:
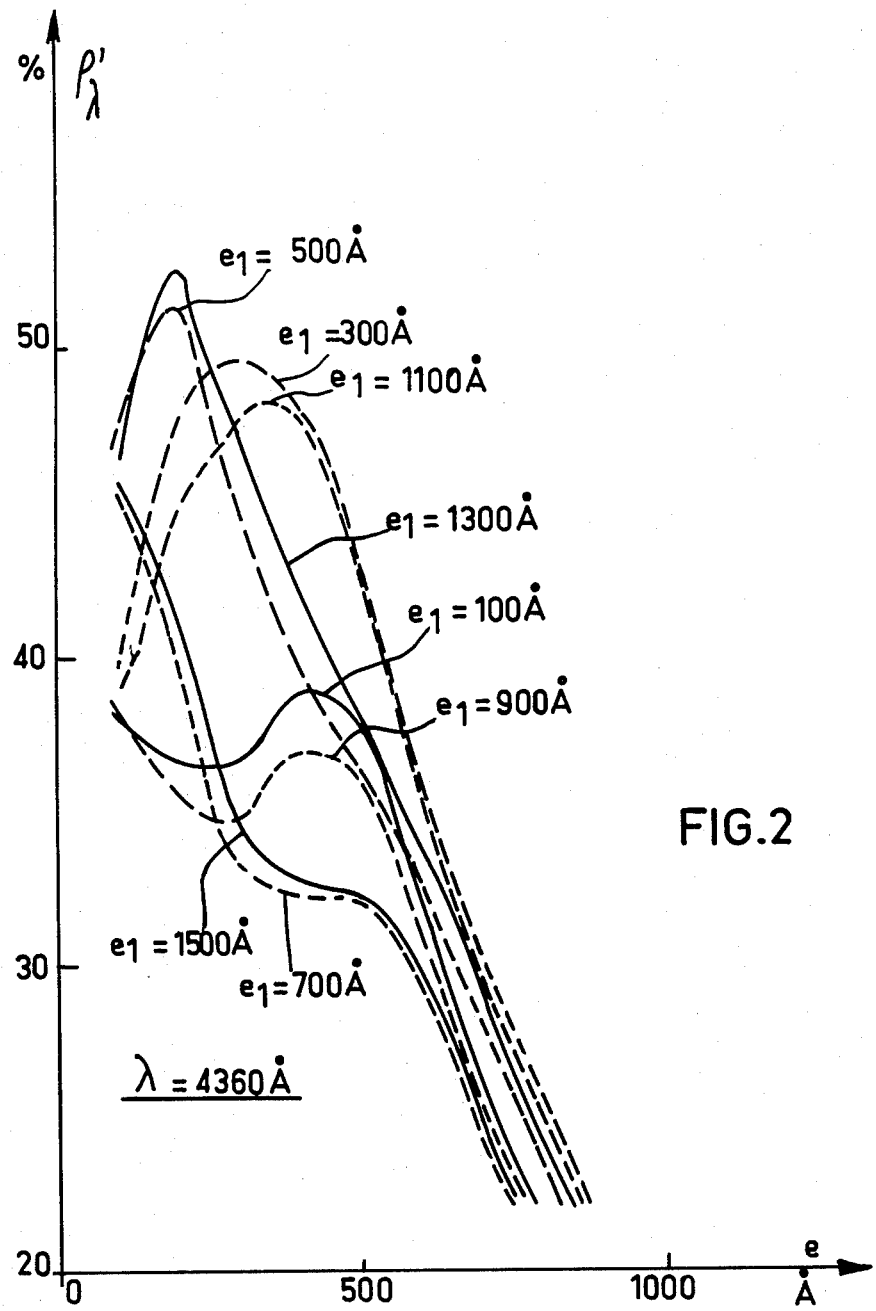
FIG. 2 is a graph showing a number of curves indicating the efficiency of the photoemission of the device as a function of the thickness e of the photosensitive layer for various values, $e_1$, of the intermediate layer. All curves are at a wavelength, λ, =4360 Å. The photoemissive material is (Sb $Na_2$ K, Cs) and the intermediate layer consists of $TiO_2$.
Figure 3:
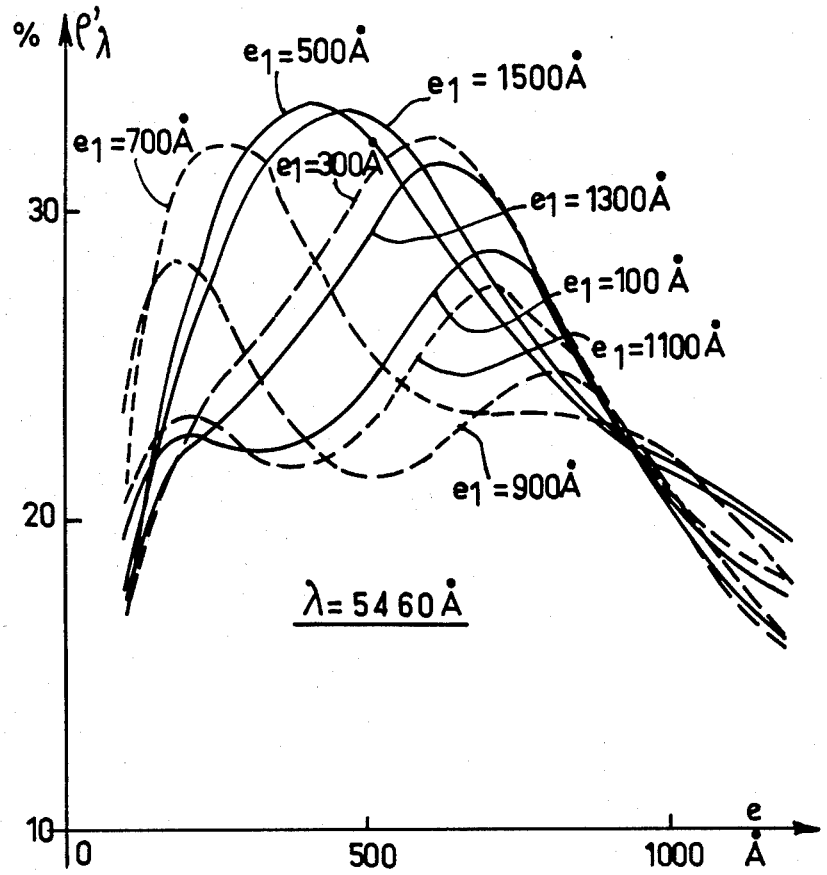
FIG. 3 is a graph showing a number of similar curves indicating the efficiency of the photoemission of the device at the wavelength, λ, equal to 5460 Å.
Figure 4:
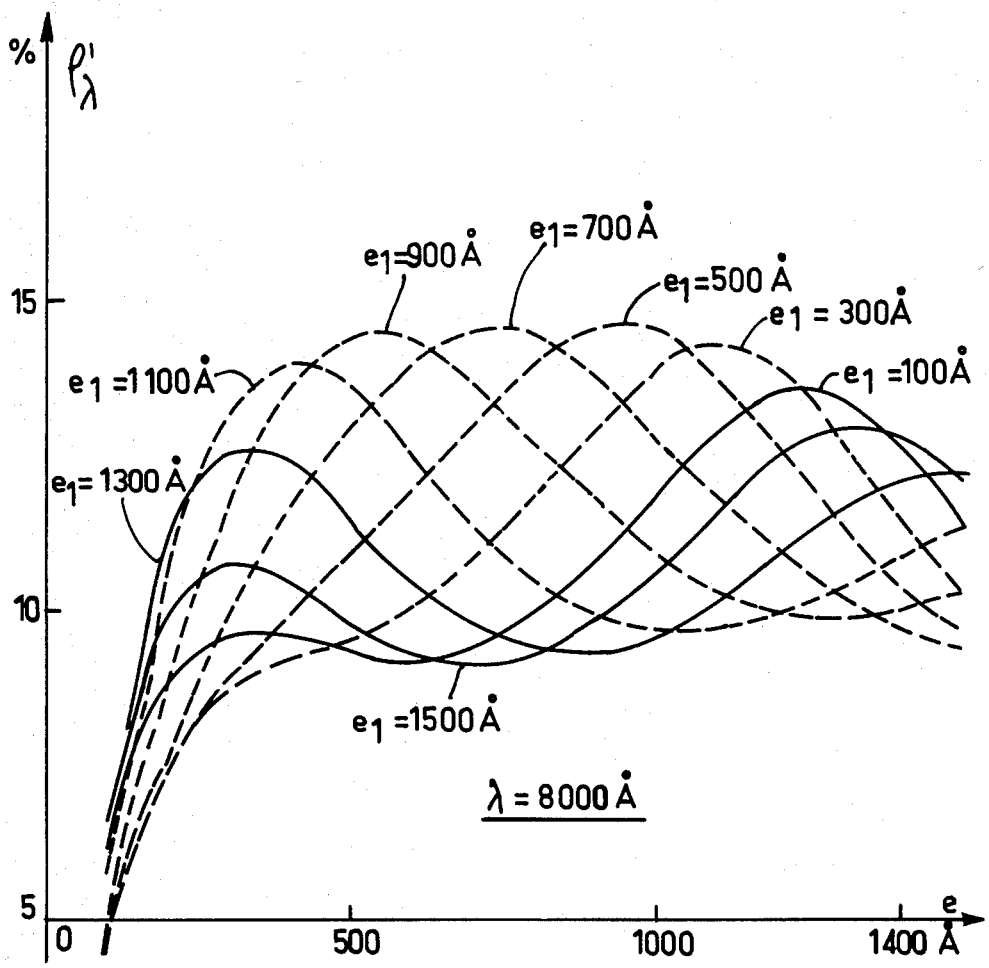
FIG. 4 is a graph showing a number of similar curves indicating the efficiency of the photoemission of the device at the wavelength, λ, equal to 8000 Å.

According to this first embodiment, the intermediate layer provided between, the photosensitive layer and the substrate is a layer consisting of, for example, $TiO_2$ having a refractive index of 2.6. FIGS. 2,3, and 4 show the variations of the efficiency as a function of the thickness e of the photosensitive layer, for the colours blue, green and red, respectively, centered on the wavelengths λ=4360 Å λ=5460 Å, and λ=8000 Å, respectively. In these figures, each curve represents a value of $e_1$ of the intermediate layer. The efficiency ρ'λ of the photoemission of the structure is optimum in each of the spectral ranges when the values of e and $e_1$ optimum correspond to the values on lines 4 and 5 of Table I. In each case the optimum efficiency itself in line 6. On line 7 is indicated the ratio ρ'λ/ρλ is shown, equal to 1.3, 1.25, and 1.1 in the blue, green and red spectral regions, respectively. The most important photoelectric gain is thus obtained in the blue light with a thickness of the photocathode comparable to photosensitive layers of the type S 20 of the same composition directly provided on the substrate.

The photoelectric detection structure according to the invention is not restricted to that corresponding to the thicknesses e and $e_1$ having the values indicated in Table I.

TABLE I

| | BLUE λ = 4360 Å | GREEN λ = 5460 Å | RED λ = 8000 Å |
|---|---|---|---|
| e (Å) | 100 | 800 | 1300 |
| $P_\lambda$ % | 40 | 27 | 13 |
| $e_1$ (Å) | 1300 | 500 | 700 |
| eÅ | 200 | 400 | 750 |
| $\rho_\lambda$'% | 52.5 | 33.5 | 14.5 |
| $\frac{\rho_\lambda'}{\rho_\lambda}$ | 1.3 | 1.25 | 1.1 |

Moreover, as may be seen from each of the FIGS. 2, 3 and 4, other values of e and $e_1$ exist for which the efficiency of the photoemission is very optimum. Each pair of values corresponds to a modified embodiment of the invention. These values are recorded in Table II, below, for each of the spectral ranges.

TABLE II

| λ | BLUE λ = 4360 Å | GREEN λ = 5460 Å | RED λ = 8000 Å |
|---|---|---|---|
| $e_1$ (Å) | 1300 1100 500 300 | 1500 1300 700 500 300 | 1100 900 700 500 300 |
| e (Å) | 200 350 200 300 | 450 600 250 400 600 | 400 500 750 950 1100 |
| e + $e_1$ (Å) | 1500 1450 700 600 | 1950 1900 950 900 900 | 1500 1400 1450 1450 1400 |

In the blue and green spectral regions, the values of e and $e_1$ are grouped in two combinations, each corresponding to a sum of the thicknesses e and $e_1$ which are very constant. That is to say, in the blue range $e+e_1=1450$ Å and $e+e_1=700$ Å, and in the green range $e+e_1=1900$ Å, $e=e_1=900$ Å. In the red range the value pairs form a combination for which it holds that $e+e_1=1450$ Å. Taking into account the accuracy of the measurements, the invention also includes structures for which the sum $e+e_1$ is approximately equal to the above-mentioned values within a tolerance range of ±15%. For spectral ranges having different wavelengths, the invention provides devices which are defined in an analogous manner and the sums $e+e_1$ of which are characteristic of the spectral ranges described.

A second embodiment according to the invention consists of photoelectric detection devices for use in the visible and in the near infrared spectra, while maintaining the sensitivity in these spectra as uniform as possible. The device chosen has, for example, a photosensitive layer of (Sb $Na_2$ K, Cs) and an intermediate layer of $TiO_2$. The thicknesses e and $e_1$ are on the order of magnitude of $e_1=500$ Å and $e=900$ Å.

Figure 5:
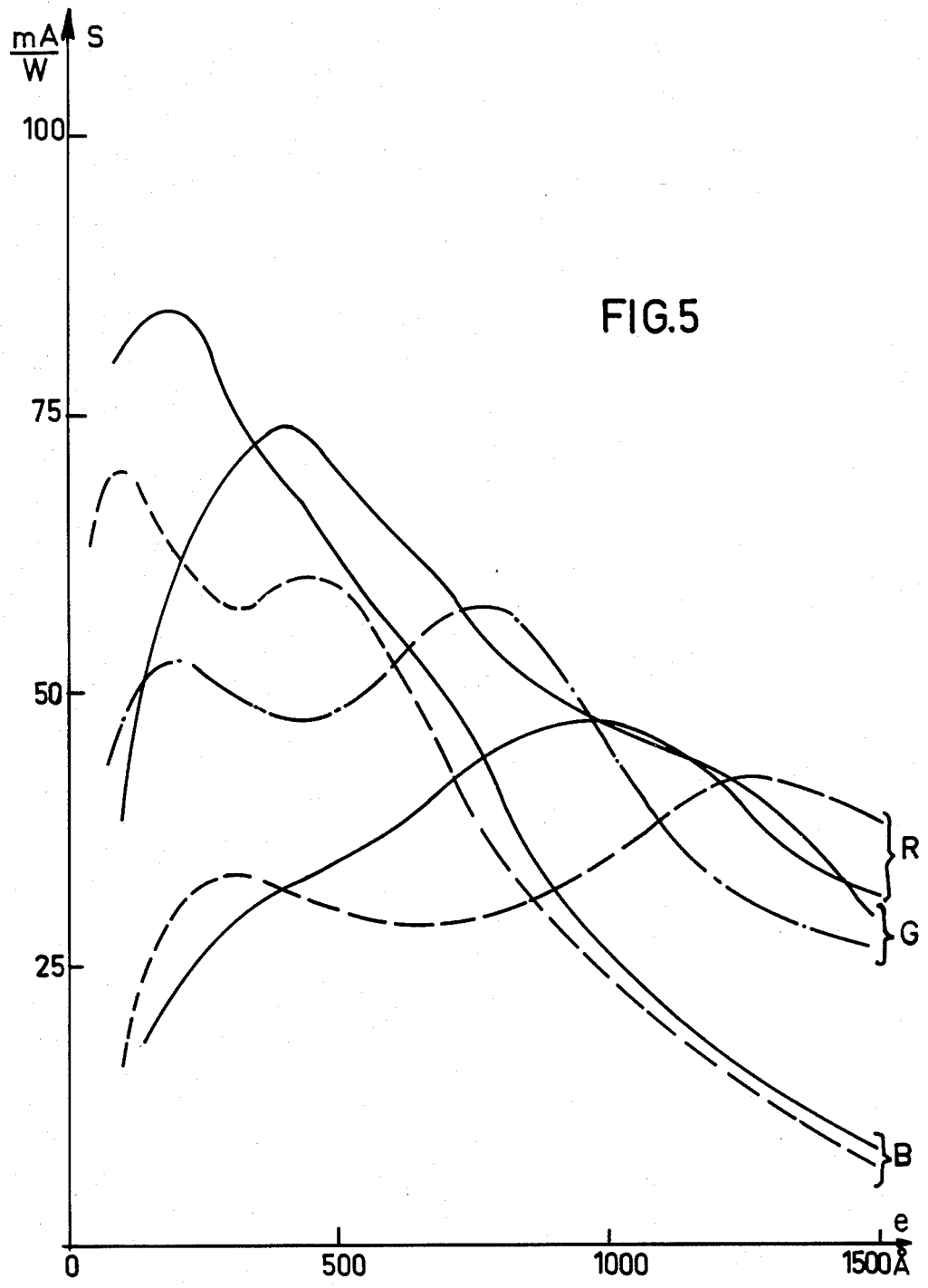
FIG. 5 is a graph showing a number of curves indicating the energy sensitivity as a function of the thickness e of the photosensitive layer of a photoemission device with or without an intermediate layer of $TiO_2$ having a thickness of $e_1=500$ Å.

FIG. 5 shows three pairs of curves denote by B, G, and R. These curves denote the energy sensitivity in milliamperes per Watt of the photoelectric detection structures in the blue, green and red regions of the spectrum, respectively, dependent on the thickness, e, of the photosensitive layer. The broken line curves relate to a device having a photosensitive layer provided directly on the substrate, the solid line curves relate to a device having a photosensitive layer on an intermediate layer having a thickness $e_1=500$ Å. The probability P (W, O) of the escape of the electrons from the photosensitive layer being assumed to be equal to 0.5 in both cases.

These curves of FIG. 5 make it possible to compare the sensitivity of the photoelectric device according to the invention with that of a photosensitive layer directly on the glass and the thickness of which must be 1300 Å. This photoelectric amplification according to the invention with respect to the layer directly on the substrate is on the order of magnitude of 1.1 for the red, 1.5 for the green, and 2.5 for the blue.

Figure 6:
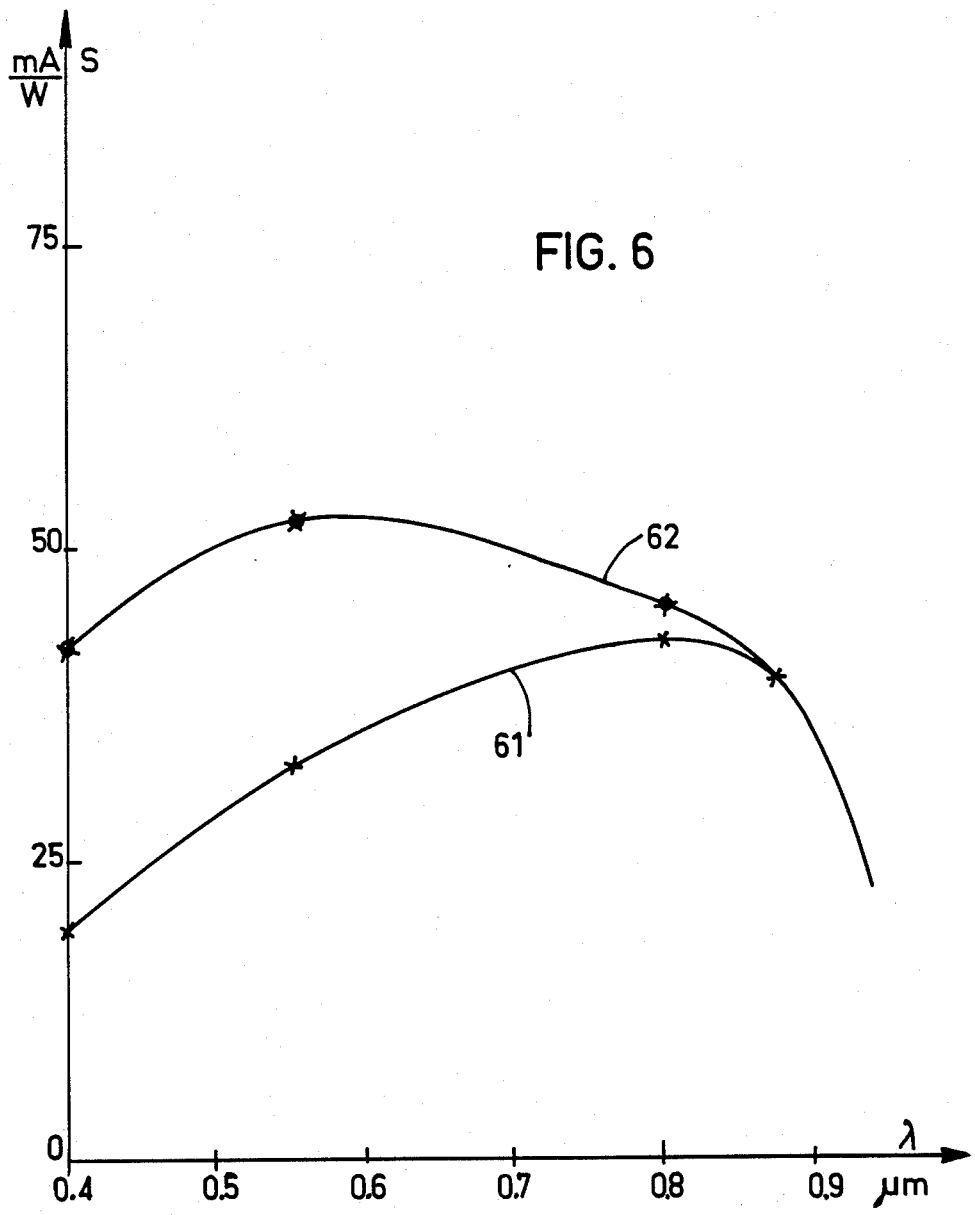
FIG. 6 is a graph showing the spectral energy sensitivity of a photoemission device according to the invention as a function of the wavelength of the light, where the device has an intermediate layer having a thickness of $e_1=500$ Å consisting of $TiO_2$, and the device has photosensitive layer having a thickness of e =900 Å consisting of (Sb $Na_2$ K, Cs).

The consequences of the photoelectric amplification according to the invention are indicated by means of the curves 61 and 62 in FIG. 6. These curves show the variations of the energy sensitivity expressed in mA per Watt as a function of the wavelength of the incident light for the photosensitive layer directly on the substrate and for the structure according to the invention, respectively. With respect to the former layer, the sensitivity for the blue and the green becomes larger and thus presents a certain uniformity.

Of course the invention also includes all devices in which a photosensitive layer and a transparent intermediate layer ($K_1$#0) is provided on a substrate, the refractive index of the intermediate layer being between that of the substrate and that of the photosensitive material.

In this manner the photosensitive layer according to the modified embodiments is bialkaline according to the chemical formula Sb Ax By (where A and B are alkali metals and x, y are coefficients) when it is concerned with increasing the sensitivity in the blue and the green regions, or according to the chemical formula Sb, Ax when it is concerned with increasing the sensitivity only in the blue region, or according to the chemical formula Ag O Sc when it is concerned with increasing the sensitivity in the whole visible spectrum and in the rear infrared spectrum.

In addition the material $TiO_2$ of the intermediate layer may be, for example, replaced by $Ta_2O_5$ or also $In_2O_3$ or $SnO_2$ (except in the presence of sodium) or SiO, MnO, $Al_2O_3$, $Si_3N_4$, MgO or also lanthanum glass provided in a thin layer. When the materials of the photosensitive layer and of the intermediate layer are as stated above, the thicknesses e and $e_1$ of the photosensitive layer and the intermediate layer have substantially the same values as those indicated in Tables I and II, in which deviations of 15% are permitted without considerably deviating from the optimum value of the efficiency of the photoemission of the device.

Among the other advantages indicated for the device according to the invention are the small thicknesses of the photosensitive layer as compared with that of prior art devices. In addition, that certain intermediate layers, for example $SnO_2$ and $In_2O_3$, stabilize the electric potential on the surface of the photosensitive layer when the devices are used as photocathodes due to a very low electric resistance.

What is claimed is:

1. A photoelectric detection device for detecting radiation in a given spectral region, said device comprising:

an envelope enclosing an evacuated space;

a substrate on the envelope, said substrate being transparent to radiation in the spectral region;

an intermediate layer provided inside the envelope on the substrate, said intermediate layer being transparent to radiation in the spectral region; and a photosensitive layer provided inside the envelope on a side of the intermediate layer opposite to the substrate, said photosensitive layer having a first side adjacent to the intermediate layer and a second side opposite to the first side, said photosensitive layer having an escaping depth of photoelectrons;

characterized in that:

the substrate, the intermediate layer, and the photosensitive layer each have a refractive index, the refractive index of the intermediate layer being between the refractive index of the substrate and the refractive index of the photosensitive layer; and the intermediate layer and the photosensitive layer each have thicknesses chosen so that absorption of radiation in the spectral region occurs substantially in a portion of the photosensitive layer adjacent to the second side of the photosensitive layer and said portion having a thickness on the order of magnitude of the escaping depth of photoelectrons in the photosensitive layer.

2. A photoelectric detection device as claimed in claim 1, characterized in that:

the substrate comprises glass having a refractive index on the order of magnitude of 1.5;

the photosensitive layer consists essentially of a material from the group consisting of $SbA_xB_yCs$, $SbA_xB_y$, $SbA_x$, and AgOCs, where A and B are alkali metals and x and y are between 0 and 3; and the intermediate layer has a refractive index between 1.9 and 2.6 and is chemically compatible with the photosensitive layer.

3. A photoelectric detection device as claimed in claim 2, characterized in that:

the thickness of the intermediate layer is 1300 angstroms ±195 angstroms; and the thickness of the photosensitive layer is 200 angstroms ±30 angstroms.

4. A photoelectric detection device as claimed in claim 2, characterized in that:

the thickness of the intermediate layer is 1100 angstroms ±165 angstroms; and the thickness of the photosensitive layer is 350 angstroms ±52.5 angstroms.

5. A photoelectric detection device as claimed in claim 2, characterized in that:

the thickness of the intermediate layer is 500 angstroms ±75 angstroms; and the thickness of the photosensitive layer is 200 angstroms ±30 angstroms.

6. A photoelectric detection device as claimed in claim 2, characterized in that:

the thickness of the intermediate layer is 300 angstroms ±45 angstroms; and the thickness of the photosensitive layer is 300 angstroms ±45 angstroms.

7. A photoelectric detection device as claimed in claim 2, characterized in that:

the thickness of the intermediate layer is 1500 angstroms ±225 angstroms; and the thickness of the photosensitive layer is 450 angstroms ±67.5 angstroms.

8. A photoelectric detection device as claimed in claim 2, characterized in that:

the thickness of the intermediate layer is 1300 angstroms ±195 angstroms; and the thickness of the photosensitive layer is 600 angstroms ±90 angstroms.

9. A photoelectric detection device as claimed in claim 2, characterized in that:

the thickness of the intermediate layer is 700 angstroms ±105 angstroms; and the thickness of the photosensitive layer is 250 angstroms ±37.5 angstroms.

10. A photoelectric detection device as claimed in claim 2, characterized in that:

the thickness of the intermediate layer is 500 angstroms ±75 angstroms; and the thickness of the photosensitive layer is 400 angstroms ±60 angstroms.

11. A photoelectric detection device as claimed in claim 2, characterized in that:

the thickness of the intermediate layer is 300 angstroms ±45 angstroms; and the thickness of the photosensitive layer is 600 angstroms ±90 angstroms.

12. A photoelectric detection device as claimed in claim 2, characterized in that:

the thickness of the intermediate layer is 1100 angstroms ±165 angstroms; and the thickness of the photosensitive layer is 400 angstroms ±60 angstroms.

13. A photoelectric detection device as claimed in claim 2, characterized in that:

the thickness of the intermediate layer is 900 angstroms ±135 angstroms; and the thickness of the photosensitive layer is 500 angstroms ±75 angstroms.

14. A photoelectric detection device as claimed in claim 2, characterized in that:

the thickness of the intermediate layer is 700 angstroms ±105 angstroms; and the thickness of the photosensitive layer is 750 angstroms ±112.5 angstroms.

15. A photoelectric detection device as claimed in claim 2, characterized in that:

the thickness of the intermediate layer is 500 angstroms ±75 angstroms; and the thickness of the photosensitive layer is 950 angstroms ±142.5 angstroms.

16. A photoelectric detection device as claimed in claim 2, characterized in that:

the thickness of the intermediate layer is 300 angstroms ±45 angstroms; and the thickness of the photosensitive layer is 1100 angstroms ±165 angstroms.

17. A photoelectric detection device as claimed in claim 2, characterized in that:

the photosensitive layer consists essentially of a material from the group consisting of $SbK_2Cs$, $SbK_2Rb$, $SbRb_2Cs$, $SbCs_3$, and AgOCs; and the intermediate layer consists essentially of a material from the group consisting of $TiO_2$, $Ta_2O_5$, $In_2O_3$, $SnO_2$, SiO, MnO, $Al_2O_3$, $Si_3N_4$, MgO, and lanthanum glass.

18. A photoelectric detection device as claimed in claim 17, characterized in that:

the thickness of the intermediate layer is 500 angstroms ±75 angstroms; and the thickness of the photosensitive layer is 900 angstroms ±135 angstroms.

19. A photoelectric detection device as claimed in claim 2, characterized in that:

the photosensitive layer consists essentially of a material from the group consisting of $SbK_2Cs$, $SbNa_2KCs$, $SbK_2Rb$, $SbRb_2Cs$, $SbCs_3$, and AgOCs; and the intermediate layer consists essentially of a material from the group consisting of $TiO_2$, $Ta_2O_5$, SiO, MnO, $Al_2O_3$, MgO, $Si_3N_4$, and lanthanum glass.

20. A photoelectric detection device as claimed in claim 19, characterized in that:

the thickness of the intermediate layer is 500 angstroms ±75 angstroms; and the thickness of the photosensitive layer is 900 angstroms ±135 angstroms.

* * * * *